US007992688B2

(12) United States Patent
Utsunomiya et al.

(10) Patent No.: US 7,992,688 B2
(45) Date of Patent: Aug. 9, 2011

(54) DOOR DEVICE FOR AN ELEVATOR

(75) Inventors: Kenji Utsunomiya, Tokyo (JP); Masayuki Sugahara, Tokyo (JP); Naotoshi Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 567 days.

(21) Appl. No.: 12/293,445

(22) PCT Filed: May 29, 2006

(86) PCT No.: PCT/JP2006/310663

§ 371 (c)(1),
(2), (4) Date: Sep. 18, 2008

(87) PCT Pub. No.: WO2007/138668

PCT Pub. Date: Dec. 6, 2007

(65) Prior Publication Data

US 2009/0272605 A1 Nov. 5, 2009

(51) Int. Cl.
*B66B 13/14* (2006.01)

(52) U.S. Cl. ..... 187/316; 187/391

(58) Field of Classification Search ..... 187/247, 187/248, 316, 317, 293, 296, 297, 391–393; 49/26, 28; 318/34, 45, 49, 53, 55, 59, 66, 318/68, 77

See application file for complete search history.

(56) References Cited

U.S. PATENT DOCUMENTS

| | | | | | |
|---|---|---|---|---|---|
| 4,299,308 | A | * | 11/1981 | Shung et al. | 187/316 |
| 4,776,433 | A | * | 10/1988 | Lagree et al. | 187/316 |
| 5,137,118 | A | * | 8/1992 | Iwata | 187/316 |
| 5,250,765 | A | * | 10/1993 | Mizuno et al. | 187/316 |
| 5,625,175 | A | * | 4/1997 | Gutknecht et al. | 187/316 |
| 5,711,112 | A | | 1/1998 | Barten et al. | |
| 5,864,104 | A | * | 1/1999 | Tawada et al. | 187/316 |
| 2004/0256181 | A1 | | 12/2004 | Durand et al. | |

FOREIGN PATENT DOCUMENTS

| | | | |
|---|---|---|---|
| DE | 102 97 270 | T5 | 9/2004 |
| EP | 0 947 658 | A2 | 10/1999 |
| JP | 4-247183 | A | 9/1992 |
| JP | 7-237885 | A | 9/1995 |
| JP | 10-67480 | A | 3/1998 |
| JP | 10-88902 | A | 4/1998 |
| JP | 2000-198679 | A | 7/2000 |
| JP | 2003-26381 | A | 1/2003 |
| JP | 2004-75314 | A | 3/2004 |

* cited by examiner

*Primary Examiner* — Anthony Salata
(74) *Attorney, Agent, or Firm* — Leydig, Voit & Mayer, Ltd.

(57) ABSTRACT

A door device for an elevator includes an elevator door, first and second door drive devices having first and second rotating shafts, respectively, a power transmission mechanism that moves the elevator door according to rotation of the first and second rotating shafts, and a door control device that controls movement of the elevator door. The door control device includes a first processing device that performs first arithmetic processing for controlling the first door drive device, a second processing device that performs second arithmetic processing for controlling the second door drive device, and an information transmitting unit for information transmission between the first and second processing devices.

10 Claims, 14 Drawing Sheets

DOOR DEVICE FOR AN ELEVATOR

TECHNICAL FIELD

The present invention relates to a door device for an elevator which opens and closes an elevator doorway.

BACKGROUND ART

Up to now, in order to improve the drive performance of a door, there has been proposed a slide door drive device that moves a door panel by means of the driving force of two motors. Each of those motors is controlled by a common controller (see Patent Document 1).

Patent Document 1: JP 10-88902 A

DISCLOSURE OF THE INVENTION

Problems to be Solved by the Invention

However, since one controller controls the two motors, the computation load of the controller becomes extremely large, resulting in a risk that processing cannot be performed within a control cycle. Accordingly, an expensive controller having a high processing performance is required, which makes it impossible to reduce the costs.

Also, when the respective motors are independently controlled by two controllers, for example, the setting of speed patterns of the door panel is performed by the respective controllers, independently. In this case, when the speed patterns that are different from each other are erroneously set by the respective controllers, a very large load is exerted on the door drive device per se, resulting in a risk of failure.

The present invention has been made to solve the above problems, and therefore an object of the present invention is to obtain a door device for an elevator which is capable of reducing the costs, and also preventing failure from occurring.

Means for Solving the Problems

A door device for an elevator door according to the invention includes: an elevator door that opens or closes an elevator doorway; a first door drive device having a first rotating shaft; a second door drive device having a second rotating shaft; a power transmission mechanism that moves the elevator door according to the rotations of the first rotating shaft with the second rotating shaft; and a door control device that controls movement of the elevator door. The door control device includes: a first processing device that performs first arithmetic processing for controlling the first door drive device; a second processing device that performs second arithmetic processing for controlling the second door drive device; and information transmitting means for performing information transmission between the first and second processing devices. The first processing device includes a single processing section that performs a part of the first arithmetic processing to calculate intermediate processing information, and a first individual processing section that processes the intermediate processing information to complete the first arithmetic processing. The second processing device includes a second individual processing section that processes the intermediate processing information that is received through the information transmitting means to complete the second arithmetic processing.

BEST MODE FOR CARRYING OUT THE INVENTION

Hereinafter, a description will be given of preferred embodiments of the present invention with reference to the accompanying drawings.

First Embodiment

Figure 1:
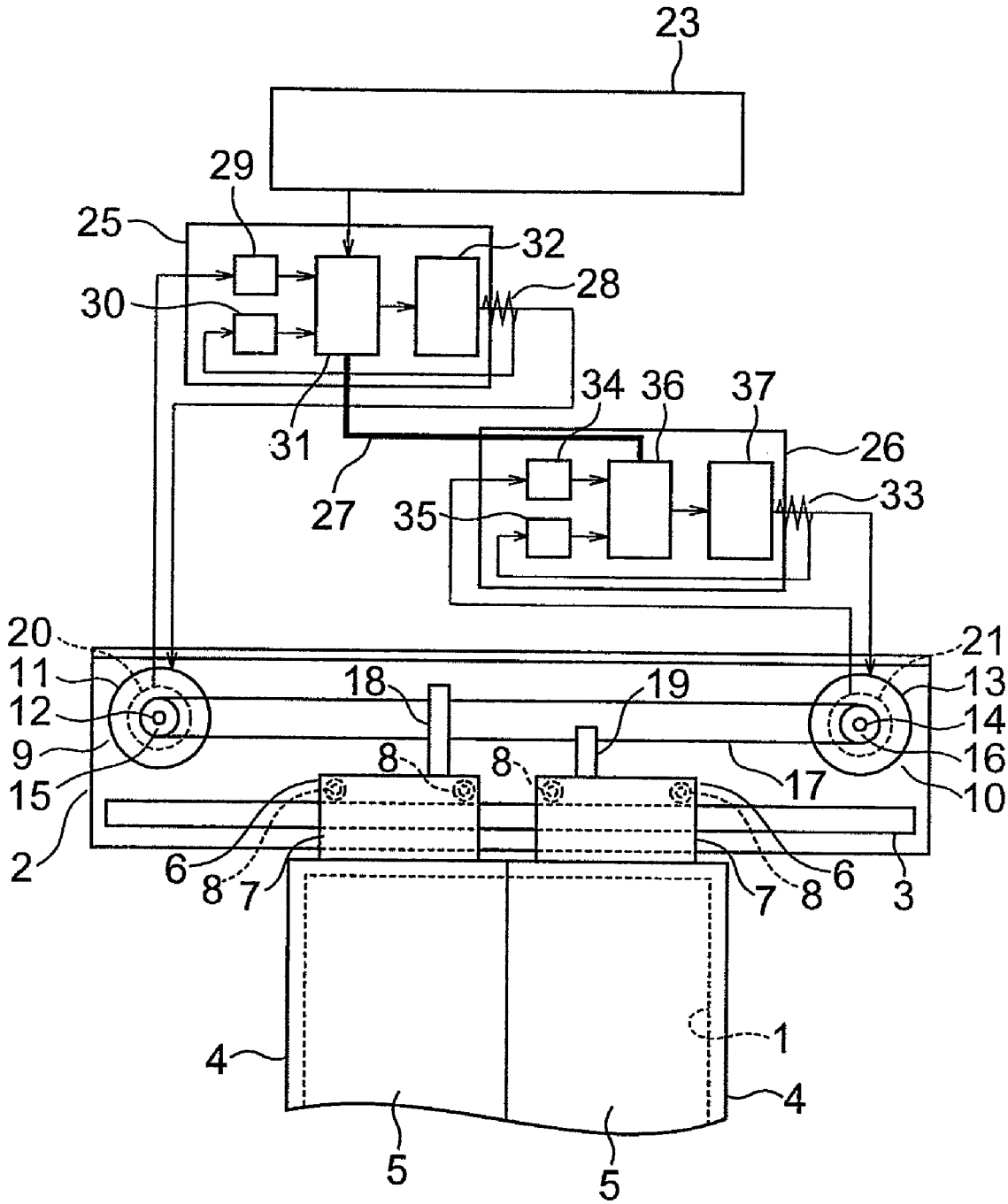
FIG. 1 is a front view showing a door device for an elevator according to a first embodiment of the present invention.

FIG. 1 is a front view showing a door device for an elevator according to a first embodiment of the present invention. In the figure, a car (not shown) is provided with a car doorway (elevator doorway) 1. Also, the car is fixed with a hanger case 2 that is disposed on the upper portion of the car doorway 1.

The hanger case 2 is fixed with a hanger rail (support rail) 3 that is arranged along the width direction of the car doorway 1. A pair of car doors (elevator doors) 4 are hang from the hanger rail 3. Each of the doors 4 of the car has a door panel 5 that opens and closes the car doorway 1, and a roller hanger 6 that is disposed on the upper portion of the door panel 5 so as to be movable along the hanger rail 3.

Each of the roller hangers 6 includes a hanger plate 7 that is fixed to the upper portion of the door panel 5, and a plurality of rollers 8 that are disposed on the hanger plate 7, and roll on the hanger rail 3 with a displacement of the door 4 of the car.

A first door drive device 9 and a second door drive device 10 which are arranged at a distance from each other in the width direction of the car doorway 1 are disposed in the hanger case 2. In this example, the first door drive device 9 is disposed on one end of the hanger case 2, and the second door drive device 10 is disposed on another end of the hanger case 2.

The first door drive device 9 includes a first drive device main body 11 that includes a motor and generates a drive force (output torque) which allows the respective doors 4 of the car to move, and a first rotating shaft 12 that rotates due to the drive force of the first drive device main body 11. The second door drive device 10 includes a second drive device main body 13 that includes a motor and generates a drive force (output torque) which allows the respective doors 4 of the car to move, and a second rotating shaft 14 that rotates due to the drive force of the second drive device main body 13.

The first rotating shaft 12 is fixed with a first pulley 15, and the second rotating shaft 14 is fixed with a second pulley 16. An endless toothed belt (power transmission strip member) 17 is wound around and between the first and second pulleys 15 and 16. The toothed belt 17 revolves by the aid of the respective rotations of the first and second pulleys 15 and 16. A power transmission mechanism that moves the respective doors 4 of the car according to the respective rotations of the first rotating shaft 12 and the second rotating shaft 14 includes the first pulley 15, the second pulley 16, and the toothed belt 17.

The respective doors 4 of the car are coupled with the toothed belt 17 through coupling members 18 and 19 so as to move in opposite directions to each other due to the revolution of the toothed belt 17. That is, one door 4 of the car is coupled with an outward portion of the toothed belt 17 through the coupling member 18 whereas another door 4 of the car is coupled with a homeward portion of the toothed belt 17 through the coupling member 19.

The first door drive device 9 is equipped with a first resolver (rotating angle detector) 20 that generates a signal corresponding to the rotation of the first rotating shaft 12. The second door drive device 10 is equipped with a second resolver (rotating angle detector) 21 that generates a signal corresponding to the rotation of the second rotating shaft 14.

In the car are mounted a host controller 23 that outputs a door open/close command at the time of starting the open/close operation of the car doorway 1, a first drive device control unit 25 that controls the first door drive device upon receiving the door open/close command from the host controller 23, and a second drive device control unit 26 that controls the second door drive device 10.

The first drive device control unit 25 and the second drive device control unit 26 are electrically connected to each other by the aid of a signal line (information transmitting means) 27. The signal line 27 performs information transmission between the first drive device control unit 25 and the second drive device control unit 26. That is, a door control unit that controls the movement of the respective doors 4 of the car includes the first drive device control unit 25, the second drive device control unit 26, and the signal line 27.

The first drive device control unit 25 adjusts the power feeding to the first door drive device 9, to thereby control the rotating speed of the first rotating shaft 12. The amount of power feeding (output torque of first door drive device 9) to the first door drive device 9 is detected by a first current detector (first torque detector) 28. The first drive device control unit 25 controls the first door drive device 9 based on information from each of the first resolver 20, the host controller 23, and the first current detector 28.

The first drive device control unit 25 includes a first resolver digital converter 29, a first current detector digital converter 30, a first CPU (first processing device) 31, and a first drive circuit 32.

The first resolver digital converter 29 converts the signal from the first resolver 20 into a digital signal, and transmits the converted digital signal to the first CPU 31 as first actually measured speed information.

The first current detector digital converter 30 converts a signal from the first current detector 28 into a digital signal, and transmits the converted digital signal to the first CPU 31 as first output torque information.

The first CPU 31 performs first arithmetic processing for controlling the first door drive device 9 based on the information from each of the host controller 23, the first resolver digital converter 29, and the first current detector digital converter 30. Through the first arithmetic processing by the first CPU 31, a voltage command for controlling the power feeding to the first door drive device 9 is calculated as first voltage command information. Also, the results of the first arithmetic processing, that is, the first voltage command information is transmitted to the first drive circuit 32 from the first CPU 31.

The first drive circuit 32 performs the power feeding to the first door drive device 9 correspondingly to the first voltage command information from the first CPU 31.

The second drive device control unit 26 adjusts the power feeding to the second door drive device 10, to thereby control the rotating speed of the second rotating shaft 14. The amount of power feeding (output torque of second door drive device 10) to the second door drive device 10 is detected by a second current detector (second torque detector) 33. The second drive device control unit 26 controls the second door drive device 10 based on information from each of the second resolver 21, the first drive device control unit 25, and the second current detector 33. The information from the first drive device control unit 25 is transmitted to the second drive device control unit 26 through the signal line 27.

The second drive device control unit 26 includes a second resolver digital converter 34, a second current detector digital converter 35, a second CPU (second processing device) 36, and a second drive circuit 37.

The second resolver digital converter 34 converts the signal from the second resolver 21 into a digital signal, and transmits the converted digital signal to the second CPU 36 as second actually measured speed information.

The second current detector digital converter 35 converts a signal from the second current detector 33 into a digital signal, and transmits the converted digital signal to the second CPU 36 as second output torque information.

The second CPU 36 performs second arithmetic processing for controlling the second door drive device 10 based on the information from each of the first drive device control unit 31, the second resolver digital converter 34, and the second current detector digital converter 35. Through the second arithmetic processing by the second CPU 36, a voltage command for controlling the power feeding to the second door drive device 10 is calculated as second voltage command information. Also, the results of the second arithmetic processing, that is, the second voltage command information is transmitted to the second drive circuit 37 from the second CPU 36.

The second drive circuit 37 performs the power feeding to the second door drive device 10 correspondingly to the second voltage command information from the second CPU 36.

Figure 2:
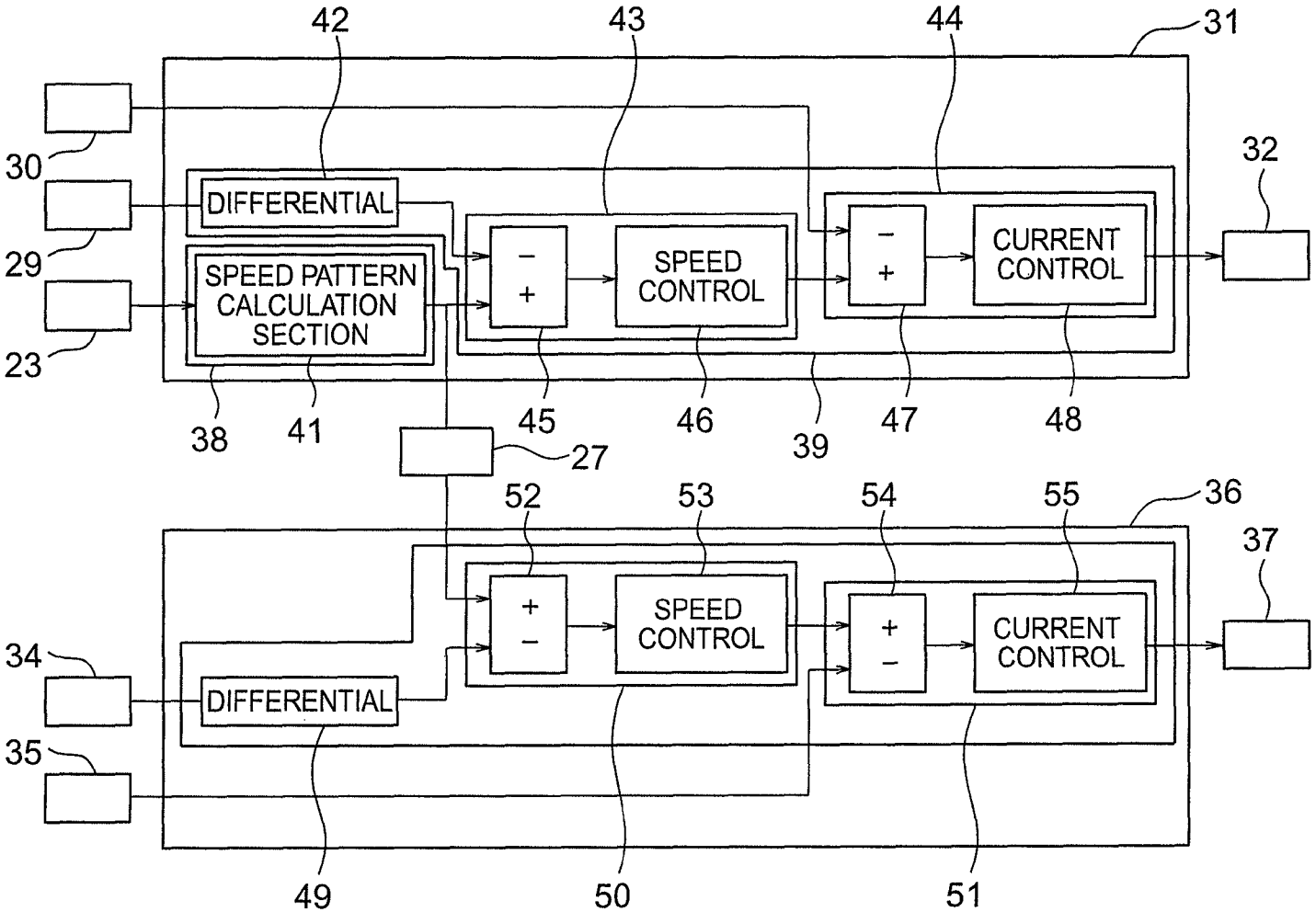
FIG. 2 is a functional block diagram showing the first CPU and the second CPU shown in FIG. 1.

FIG. 2 is a functional block diagram showing the first CPU 31 and the second CPU 36 shown in FIG. 1. In the figure, the first CPU 31 includes a single processing section 38 that performs a part of the first arithmetic processing to calculate intermediate processing information, and a first individual processing section 39 that processes the intermediate processing information to complete the first arithmetic processing. Also, the second CPU 36 includes a second individual processing section 40 that processes the intermediate processing information from the single processing section 38 to complete the second arithmetic processing. The intermediate processing information from the single processing section 38 is transmitted to the second individual processing section 40 through the signal line 27.

The single processing section 38 includes a speed pattern calculation section 41 that receives the door open/close command from the host controller 23 to calculate a given speed pattern as door speed command information. The respective rotating speeds of the first and second rotating shafts 12 and 14 change along the given speed pattern that has been calculated by the speed pattern calculation section 41.

The door speed command information from the speed pattern calculation section 41 is transmitted to each of the first individual processing section 39 and the second individual processing section 40. That is, the door speed command information corresponds to the intermediate processing information. The calculation of the given speed pattern is performed by selecting the given speed pattern from a plurality of speed patterns that have been stored in the first drive device control unit 25 in advance.

The first individual processing section 39 includes a first differential section 42, a first torque command section 43, and a first voltage command section 44.

The first differential section 42 differentiates the first actually measured speed information (digital signal) from the first resolver digital converter 29 to obtain first rotating angle speed information. Accordingly, the first rotating angle speed information is a signal corresponding to the rotating speed of the first rotating shaft 12.

The first torque command section 43 includes a first speed information comparison section 45 that obtains a difference between the first rotating angle speed information from the first differential section 42 and the door speed command information (intermediate processing information) from the speed pattern calculation section 41, and a first speed control section 46 that calculates, based on information from the first speed information comparison section 45, a torque command for controlling the output torque of the first door drive device 9 as first torque command information.

The first voltage command section 44 includes a first torque information comparison section 47 that obtains a difference between the first output torque information (digital signal) from the first current detector digital converter 30 and the first torque command information from the first torque command section 43, and a first current control section 48 that calculates the first voltage command information based on information from the first torque information comparison section 47. The first voltage command information is transmitted to the first drive circuit 32 from the first current control section 48.

The second individual processing section 40 includes a second differential section 49, a second torque command section 50, and a second voltage command section 51.

The second differential section 49 differentiates the second actually measured speed information (digital signal) from the second resolver digital converter 34 to obtain second rotating angle speed information. Accordingly, the second rotating angle speed information is a signal corresponding to the rotating speed of the second rotating shaft 14.

The second torque command section 50 includes a second speed information comparison section 52 that obtains a difference between the door speed command information (intermediate processing information) that has been received from the speed pattern calculation section 41 through the signal line 27 and the second rotating angle speed information from the second differential section 49, and a second speed control section 53 that calculates, based on information from the second speed information comparison section 52, a torque command for controlling the output torque of the second door drive device 10 as second torque command information.

The second voltage command section 51 includes a second torque information comparison section 54 that obtains a difference between the second output torque information (digital signal) from the second current detector digital converter 35 and the second torque command information from the second torque command section 50, and a second current control section 55 that calculates the second voltage command information based on information from the second torque information comparison section 54. The second voltage command information is transmitted to the second drive circuit 37 from the second current control section 55.

Figure 3:
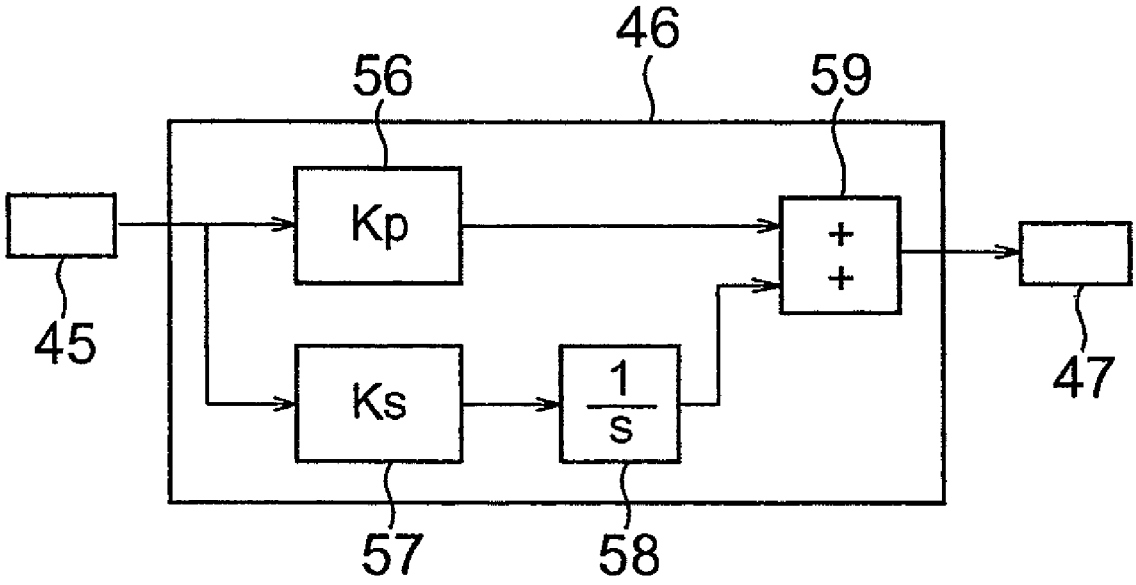
FIG. 3 is a block diagram showing the first speed control section shown in FIG. 2.

FIG. 3 is a block diagram showing the first speed control section 46 shown in FIG. 2. In the figure, the first speed control section 46 includes a multiplier 56 and a multiplier 57 which calculate a signal that is proportional to the information from the speed information comparison section 45, respectively, an integrator 58 that calculates a signal corresponding to an integration value of information from the multiplier 57, and an adder 59 that adds respective information from the multiplier 56 and the integrator 58 together. That is, the arithmetic algorithm of the first speed control section 46 is subjected to PI control. A control constant in the multiplier 56 is Kp, and a control constant in the multiplier 57 is Ks.

The configuration of the second speed control section 53 is identical with that of the first speed control section 46. That is, the arithmetic algorithm of the second speed control section 53 is subjected to PI control as with the first speed control section 46.

Here, the door speed command information from the speed pattern calculation section 41 is transmitted to the second torque command section 50 through the signal line 27. As a result, the second torque command section 50 receives the door speed command information later than the first torque command section 43. The magnitude of the receive delay of the door speed command information differs depending on a transmission speed or a control cycle of the signal line 27, and becomes about several msec to several tens msec. Accordingly, a displacement occurs between temporal change in the door speed command information which is received by the first torque command section 43, and temporal change in the door speed command information which is received by the second torque command section 50.

On the other hand, the first pulley 15 and the second pulley 16 are mechanically (mechanistically) coupled with each other by means of the toothed belt 17. Therefore, no large difference occurs between the respective rotating speeds of the first and second pulleys 15 and 16.

Figure 4:
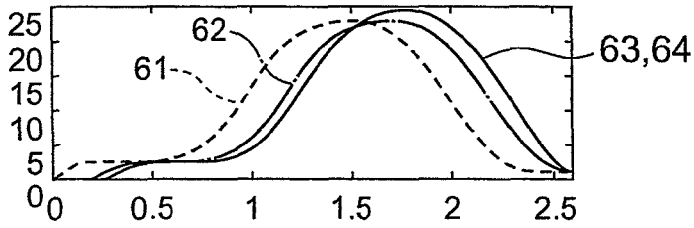
FIG. 4 is a graph showing temporal change in the respective door speed command information that are received by the respective first and second torque command sections shown in FIG. 3, and the signals of the respective rotating speeds that are detected by the respective first and second resolvers.

FIG. 4 is a graph showing temporal change in the respective door speed command information that are received by the respective first and second torque command sections 43 and 50 shown in FIG. 3, and the signals of the respective rotating speeds that are detected by the respective first and second resolvers 20 and 21. As shown in the figure, door speed command information 62 that is received by the second torque command section 50 changes temporally later than door speed command information 61 that is received by the first torque command section 43. Also, both of signals 63 and 64 of the respective rotating speeds which are detected by the respective first and second resolvers 20 and 21 change in the same manner (indicated by one solid line in FIG. 4). As a result, a difference (first speed difference information) between the door speed command information 61 and the signal 63 of the rotating speed, and a difference (second speed difference information) between the door speed command information 62 and the signal 64 of the rotating speed are different from each other. For that reason, a difference occurs between the first torque command information that is calculated by the first torque command section 43 and the second torque command information that is calculated by the second torque command section 50.

The difference between the first and second torque command information leads to a difference between the output torque of the first door drive device 9 and the output torque of the second door drive device 10, which causes a risk that there occurs a trouble such as overload or an increase in temperature.

Accordingly, in this example, in order to reduce a difference between the respective output torques of the first and second door drive devices 9 and 10, the follow-up property of the second torque command section 50 with respect to the door speed command information is higher than the follow-up property of the first torque command section 43 with respect to the door speed command information. That is, the second torque command section 50 is so set as to respond to the door speed command information quicker than the first torque command section 43, to thereby correct a delay of receiving the door speed command information in the second torque command section 50.

The follow-up property of the second torque command section 50 with respect to the door speed command information is set to be higher than the follow-up property of the first torque command section 50 with respect to the door speed command information by setting the control constants Kp and Ks of the respective multipliers 56 and 57 in the second torque command section 50 to be larger than the control constants Kp and Ks of the respective multipliers 56 and 57 in the first torque command section 43.

In this example, it is assumed that a delay of receiving in the second torque command section 50 with respect to the first torque command section 43 is 10 msec, and the control constants Kp and Ks of the multipliers 56 and 57 in the second torque command section 50 is 1.1 times as large as the control constants Kp and Ks of the multipliers 56 and 57 in the first torque command section 43.

Figure 5:
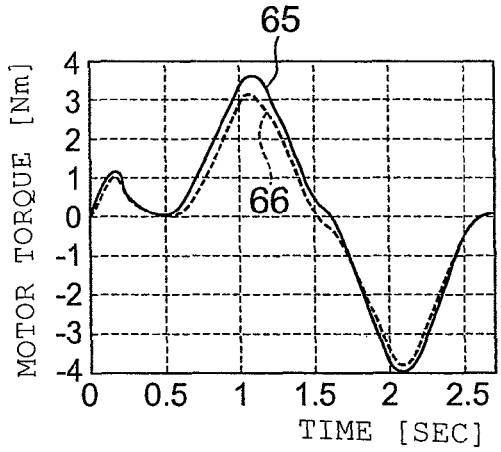
FIG. 5 is a graph showing temporal change in the respective output torques of the first and second door drive devices when the follow-up properties of the first and second torque command sections shown in FIG. 3 with respect to the respective door speed command information are identical with each other.
Figure 6:
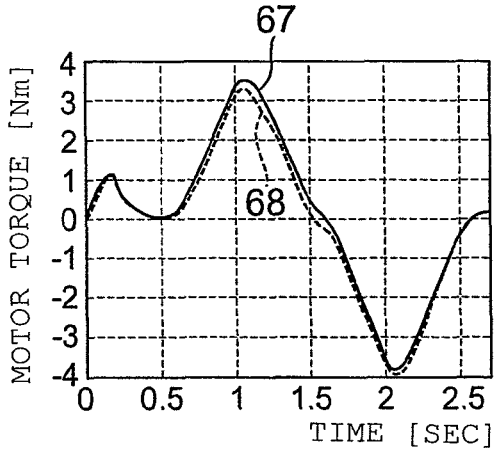
FIG. 6 is a graph showing temporal change in the respective output torques of the first and second door drive devices when the follow-up property of the second torque command section shown in FIG. 3 with respect to the door speed command information is higher than that of the first torque command section.

FIG. 5 is a graph showing temporal change in the respective output torques of the first and second door drive devices 9 and 10 when the follow-up properties of the first and second torque command sections 43 and 50 shown in FIG. 3 with respect to the respective door speed command information are identical with each other. Also, FIG. 6 is a graph showing temporal change in the respective output torques of the first and second door drive devices 9 and 10 when the follow-up property of the second torque command section 50 shown in FIG. 3 with respect to the door speed command information is higher than that of the first torque command section 43.

As shown in the figure, when the follow-up properties of the first and second torque command sections 43 and 50 with respect to the respective door speed command information are identical with each other, a difference occurs between an output torque 65 of the first door drive device 9 and an output torque 66 of the second door drive device 10 (FIG. 5). On the contrary, when the follow-up property of the second torque command section 50 with respect to the door speed command information is higher than that of the first torque command section 43, a difference between an output torque 67 of the first door drive device 9 and an output torque 68 of the second door drive device 10 is smaller than that when the follow-up properties of the first and second torque command sections 43 and 50 with respect to the respective door speed command information are identical with each other (FIG. 6). That is, the unbalance of the respective output torques of the first and second door drive devices 9 and 10 when the follow-up property of the second torque command section 50 is higher than that of the first torque command section 43 is reduced more than that when the respective follow-up properties of the first and second torque command sections 43 and 50 are identical with each other.

Then, the operation will be described. When the door open/close command is input to the first CPU 31 from the host controller 23, the given speed pattern is calculated as the door speed command information by the speed pattern calculation section 41. Thereafter, the door speed command information is transmitted to the first torque command section 43, and also transmitted to the second torque command section 50 through the signal line 27.

Thereafter, in the first torque command section 43, the first rotating angle speed information that has been received from the first resolver 20 through the first resolver digital converter 29 and the first differential section 42 is compared with the door speed command information to calculate the first torque command information. Thereafter, the first torque command information is transmitted to the first voltage command section 44.

Then, in the first voltage command section 44, the first output torque information that has been received from the first current detector 28 through the first current detector digital converter 30 is compared with the first torque command information to calculate the first voltage command information. Thereafter, the first voltage command information is transmitted to the first drive circuit 32. Then, the power feeding corresponding to the first voltage command information is performed by the first drive circuit 32 to drive the first door drive device 9.

On the other hand, in the second torque command section 50, the second rotating angle speed information that has been received from the second resolver 21 through the second resolver digital converter 34 and the second differential section 49 is compared with the door speed command information to calculate the second torque command information. Then, the second torque command information is transmitted to the second voltage command section 51.

Thereafter, in the second voltage command section 51, the second output torque information that has been received from the second current detector 33 through the second current detector digital converter 35 is compared with the second torque command information to calculate the second voltage command information. Thereafter, the second voltage command information is transmitted to the second drive circuit 37. Then, the power feeding corresponding to the second voltage command information is performed by the second drive circuit 37 to drive the second door drive device 10.

The respective first and second rotating shafts 12 and 14 are rotated by driving the first and second door drive devices 9 and 10, respectively, to move the respective doors 4 of the car. As a result, the car doorway 1 is opened and closed.

In the above door device for an elevator, the first arithmetic processing for controlling the first door drive device 9 is performed by the first CPU 31, and the door speed command information (intermediate processing information) that has been obtained by the partial execution of the first arithmetic processing is transmitted to the second CPU 36 from the first CPU 31 through the signal line 27. The second arithmetic processing for controlling the second door drive device 9 is performed by the second CPU 36 based on the door speed command information from the first CPU 31. As a result, the first and second arithmetic processing can be shared and performed by the first and second CPUs 31 and 36, respectively, thereby making it possible to reduce the respective processing loads of the first and second CPUs 31 and 36. As a result, the number of input/output ports to the CPU is not extremely increased, and the processing performance does not need to be increased by an expensive CPU. Accordingly, the costs can be reduced. Also, the unbalance of the respective output torques of the first and second door drive devices 9 and 10 can be prevented from occurring due to the information transmission through the signal line 27 between the first and second CPUs 31 and 36. As a result, the overload can be prevented from occurring in the first and second door drive devices 9 and 10 and the like, and failure can be prevented from occurring.

Also, since the intermediate processing information that is transmitted from the first CPU 31 to the second CPU 36 corresponds to the door speed command information, the first and second door drive devices 9 and 10 can be prevented from being controlled by door speed command information that are different from each other. Also, the overload of the first and second door drive devices 9 and 10 and the like can be further prevented from occurring.

Also, since the follow-up property of the first torque command section 43 with respect to the door speed command information is higher than the follow-up property of the second torque command section 50 with respect to the door speed command information, it is possible to correct the receive delay in the second CPU 36 which is caused by transmission of the information through the signal line 27. As a result, a difference between the respective output torques of the first and second door drive devices 9 and 10 can be reduced, and the overload of the first and second door drive devices 9 and 10 and the like can be further prevented from occurring.

In the above example, the arithmetic algorithms of the first and second speed control sections 46 and 53 are subjected to PI control. However, the present invention is not limited to this configuration, and another arithmetic algorithm can be applied.

Also, in the above example, the door speed command information is simultaneously output from the speed pattern calculation section 41 to the first and second torque command sections 43 and 50, respectively. However, the output of the door speed command information to the first torque command section 43 and the output of the door speed command information to the second torque command section 50 can be temporally displaced.

Also, in the above example, only the information from the first CPU 31 to the second CPU 36 is transmitted through the signal line 27. Alternatively, the information can be mutually transmitted between the first and second CPUs 31 and 36 through the signal line 27. For example, pulse signals can be continuously transmitted between the first CPU 31 and the second CPU 36 through the signal line 27 so that the first and second CPUs 31 and 36 monitor each other. That is, when abnormality occurs in one of the first and second CPUs 31 and 36, stop information of the pulse signals can be transmitted from one of the first and second CPUs 31 and 36 to another CPU through the signal line 27 as abnormality detection information. With the above configuration, it is possible to readily detect the occurrence of the respective abnormalities of the first and second CPUs 31 and 36. As a result, the occurrence of abnormality that cannot be determined by the single CPU can be detected, and an improvement in reliability of the abnormality detection can be achieved.

Also, in the above example, the number of first and second door drive devices 9 and 10 is one, respectively. Alternatively, the number of first door drive device 9 can be one, and the number of second door drive devices 10 can be multiple.

Figure 7:
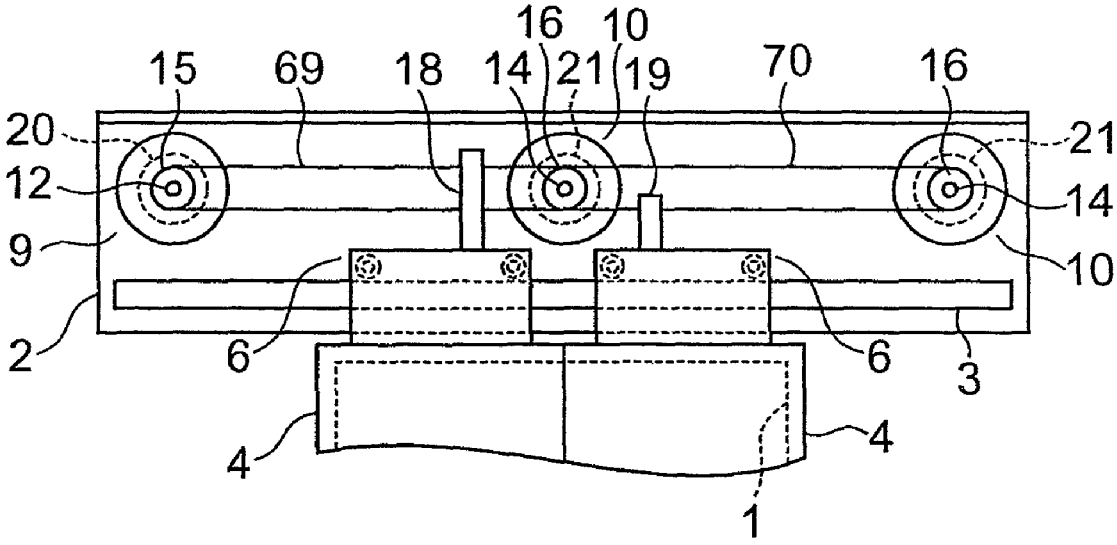
FIG. 7 is a front view showing another example of a main portion of a door device for an elevator according to a first embodiment of the present invention.

For example, as shown in FIG. 7, the first door drive device 9 and the two second door drive devices 10 can be arranged at a distance from each other in the width direction of the car doorway 1 in the hanger case 2. In this case, the first rotating shaft 12 is provided with the first pulley 15, and the two second rotating shafts 14 are provided with the second pulleys 16, respectively. Also, a toothed belt 69 that is connected with one coupling member 18 is wound between the first pulley 15 and one second pulley 16, and a toothed belt 70 that is connected with another coupling member 19 is wound between the one second pulley 16 and another second pulley 16. Further, the respective second door drive devices 10 are independently controlled by the arithmetic processing of the two second CPUs having the same function as that of the above-mentioned second CPU 36. Still further, the door speed command information (intermediate processing information) from the first CPU 31 is transmitted to the respective second CPUs through the signal line.

Second Embodiment

Figure 8:
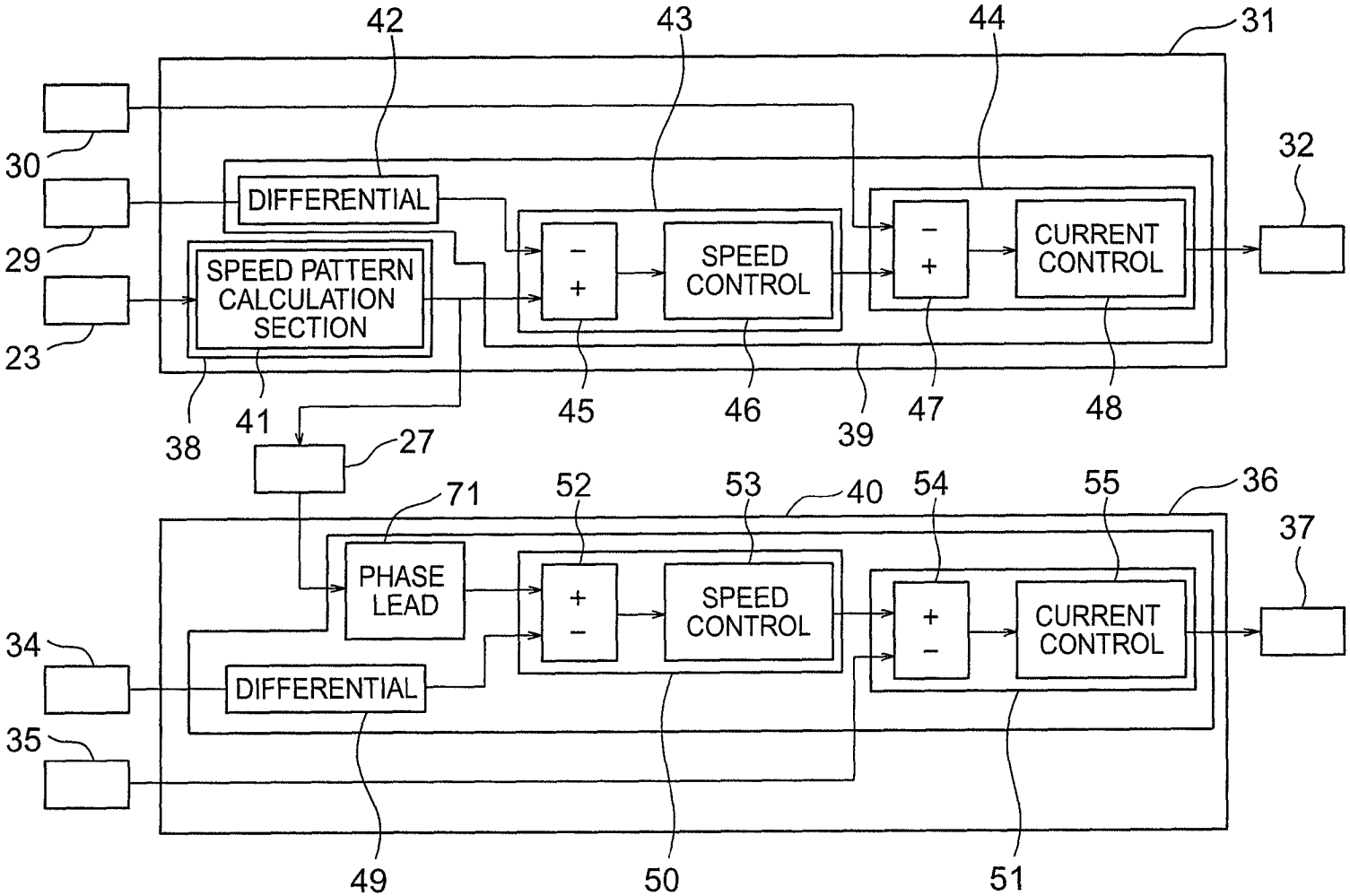
FIG. 8 is a block diagram showing a main portion of a door device for an elevator according to a second embodiment of the present invention.

FIG. 8 is a block diagram showing a main portion of a door device for an elevator according to a second embodiment of the present invention. In the figure, the second individual processing section 40 includes the second differential section 49, the second torque command section 50, the second voltage command section 51, and a phase lead section 71. The respective configurations and functions of the second differential section 49, the second torque command section 50, and the second voltage command section 51 are identical with those of the first embodiment.

The door speed command information (intermediate processing information) from the speed pattern calculation section 41 is transmitted to the phase lead section 71 through the signal line 27. The phase lead section 71 performs a phase lead compensation on the door speed command information. That is, the phase lead section 71 compensates the temporal delay of the door speed command information which is caused by the signal line 27, and transmits the compensated door speed command information to the first torque command section 50 as compensation speed information.

The transmission characteristic G(s) of the phase lead section 71 is represented by the following Expression (1).

[Ex. 1]

$$G(s) = \frac{\omega 2(s+\omega 1)}{\omega 1(s+\omega 2)} \quad (1)$$

In the expression, ω1 and ω2 are control coefficients, and ω1>ω2 is satisfied. Also, s is a Laplace operator (Laplace variable).

In this example, it is assumed that a receive delay of the second torque command section 50 with respect to the first torque command section 43 is 10 msec, and ω1=12×2π [rad/s] and ω2=24×2π [rad/s] are satisfied.

The second speed information comparison section 52 obtains a difference between the compensation speed information from the phase lead section 71 and the second rotating angle speed information from the second differential section 49. The second speed control section 53 calculates the second torque command information based on information from the second speed information comparison section 52. Also, the follow-up properties of the first and second speed control sections 46 and 53 with respect to the door speed command information are identical with each other. That is, in the first and second torque command sections 43 and 50, the control constants Kp and Ks of the respective multipliers 56 and 57 are identical with each other. Other configurations are identical with those in the first embodiment.

Figure 9:
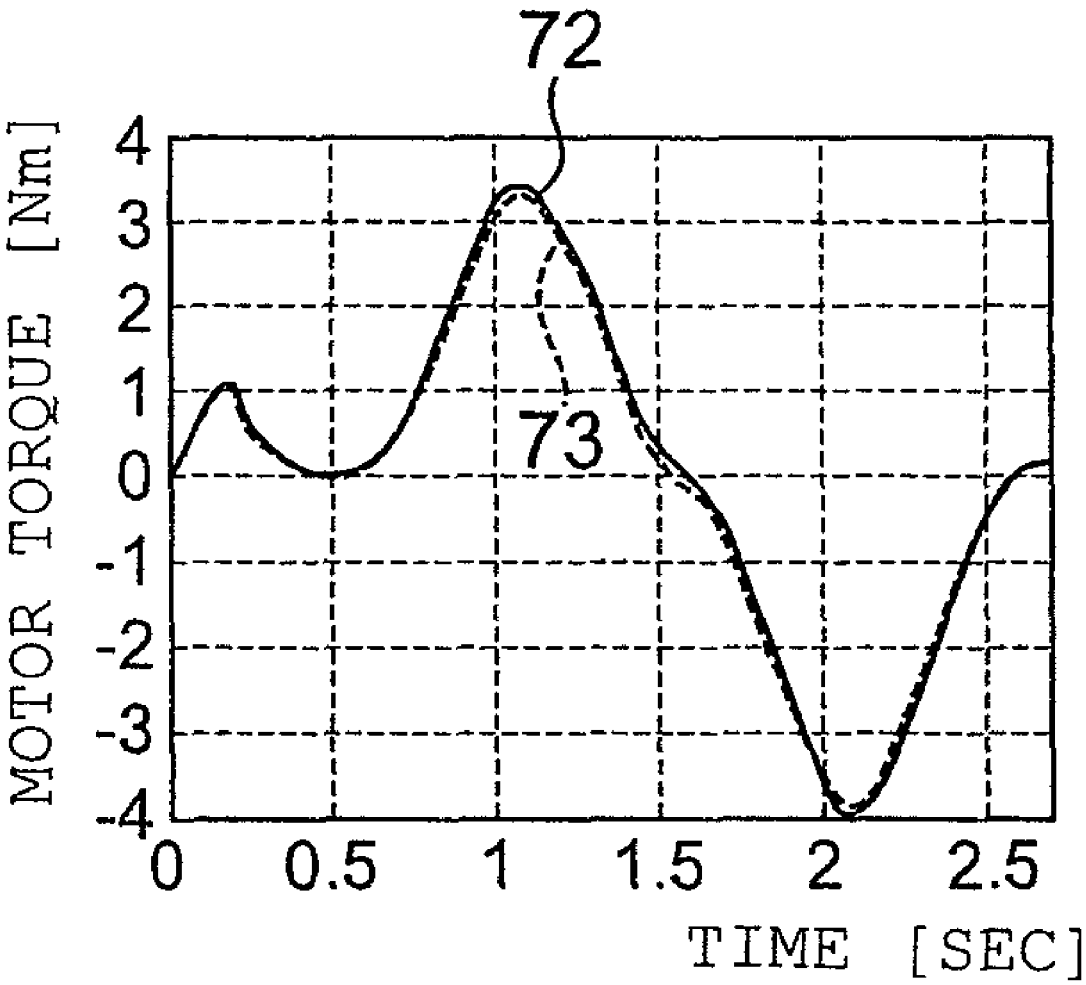
FIG. 9 is a graph showing temporal change in the respective output torques of the first and second door drive devices which are controlled by the respective arithmetic processing of the first and second CPUs shown in FIG. 8.

FIG. 9 is a graph showing temporal change in the respective output torques of the first and second door drive devices 9 and 10 which are controlled by the respective arithmetic processing of the first and second CPUs 31 and 36 shown in FIG. 8. As shown in the figure, a difference between an output torque 72 of the first door drive device 9 and an output torque 73 of the second door drive device 10 is smaller than that in a case where there is no phase lead section 71 (FIG. 5). That is, the unbalance of the respective output torques of the first and second door drive devices 9 and 10 in the case where the phase lead compensation is performed on the door speed command information by the phase lead section 71 is reduced more than that in the case where the phase lead compensation is not performed.

In the above door device for an elevator, the phase lead section 71 that performs the phase lead compensation on the door speed command information is disposed in the second individual processing section 40. The phase lead section 71 processes the information that has been received from the speed pattern calculation section 41 through the signal line 27, and transmits the processed information to the second torque command section 50. As a result, the receive delay by the second individual processing section 40 can be corrected, and the unbalance of the respective output torques of the first and second door drive devices 9 and 10 can be prevented. Accordingly, it is possible to further prevent the overload of the first and second door drive devices 9 and 10 and the like from occurring.

Third Embodiment

Figure 10:
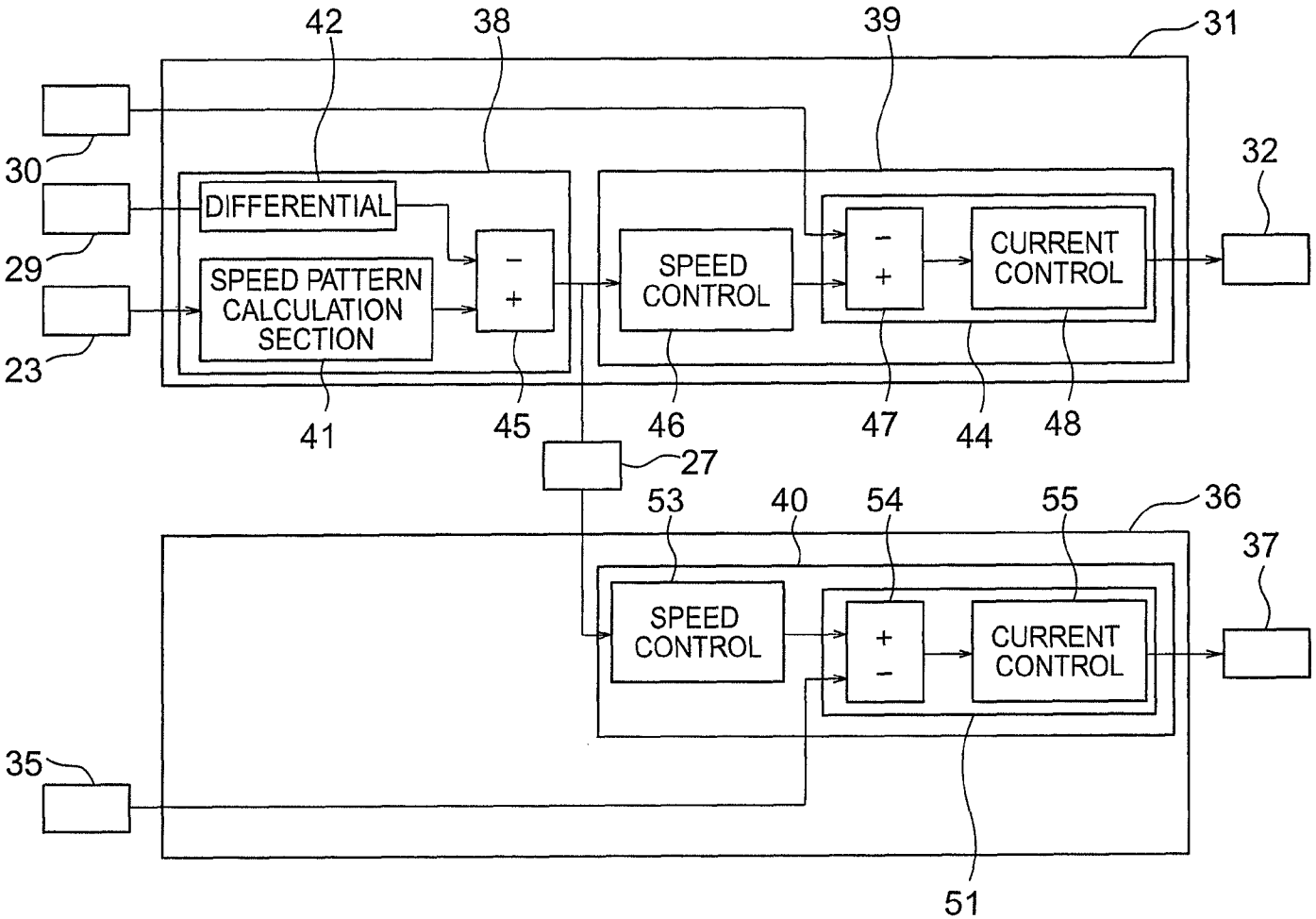
FIG. 10 is a block diagram showing a main portion of a door device for an elevator according to a third embodiment of the present invention.

FIG. 10 is a block diagram showing a main portion of a door device for an elevator according to a third embodiment of the present invention. In the figure, in this example, the information from the first speed information comparison section 45 is transmitted to the second individual processing section 40 through the signal line 27 as the intermediate processing information. That is, a difference between the door speed command information from the speed pattern calculation section 41 and the first rotating angle speed information from the first differential section 42 (i.e., information from first resolver 20) is transmitted to the second individual processing section 40 from the first CPU 31 as the intermediate processing information.

Further, the intermediate processing information from the first speed information comparison section 45 is also transmitted to the first speed control section 46. The first speed control section 46 processes the intermediate processing information to calculate the first torque command information. The first torque command information is transmitted to the first voltage command section 44 from the first speed control section 46.

That is, the single processing section 38 includes the speed pattern calculation section 41, the first differential section 42, and the speed information comparison section 45. Also, the first individual processing section 39 includes the first speed control section 46 and the first voltage command section 44. The respective configurations and functions of the speed pattern calculation section 41, the first differential section 42, the first speed information comparison section 45, the first speed control section 46, and the first voltage command section 44 are identical with the configurations and functions of the first embodiment.

The second individual processing section 40 includes the second speed control section 53 and the second voltage command section 51. The intermediate processing information from the single processing section 38 is processed by the second speed control section 53 to calculate the second torque command information. The second torque command information is transmitted to the second voltage command section 51 from the second speed control section 53. The respective configurations and functions of the second speed control section 53 and the second voltage command section 51 are identical with the configurations and functions of the first embodiment.

Accordingly, the first speed control sections 46 and 53 process the common intermediate processing information that is temporally displaced due to the receive delay of the intermediate processing information of the second speed control section 53 with respect to the first speed control section 46. That is, the second torque command information from the second speed control section 53 is equal in magnitude and shape to the first torque command information from the first speed control section 46, but temporal displacement occurs.

The second resolver 21, the second resolver digital converter 34, the second differential section 49, and the second speed information comparison section 52 shown in the first embodiment are not provided in this example. Other configurations are identical with those in the first embodiment.

Figure 11:
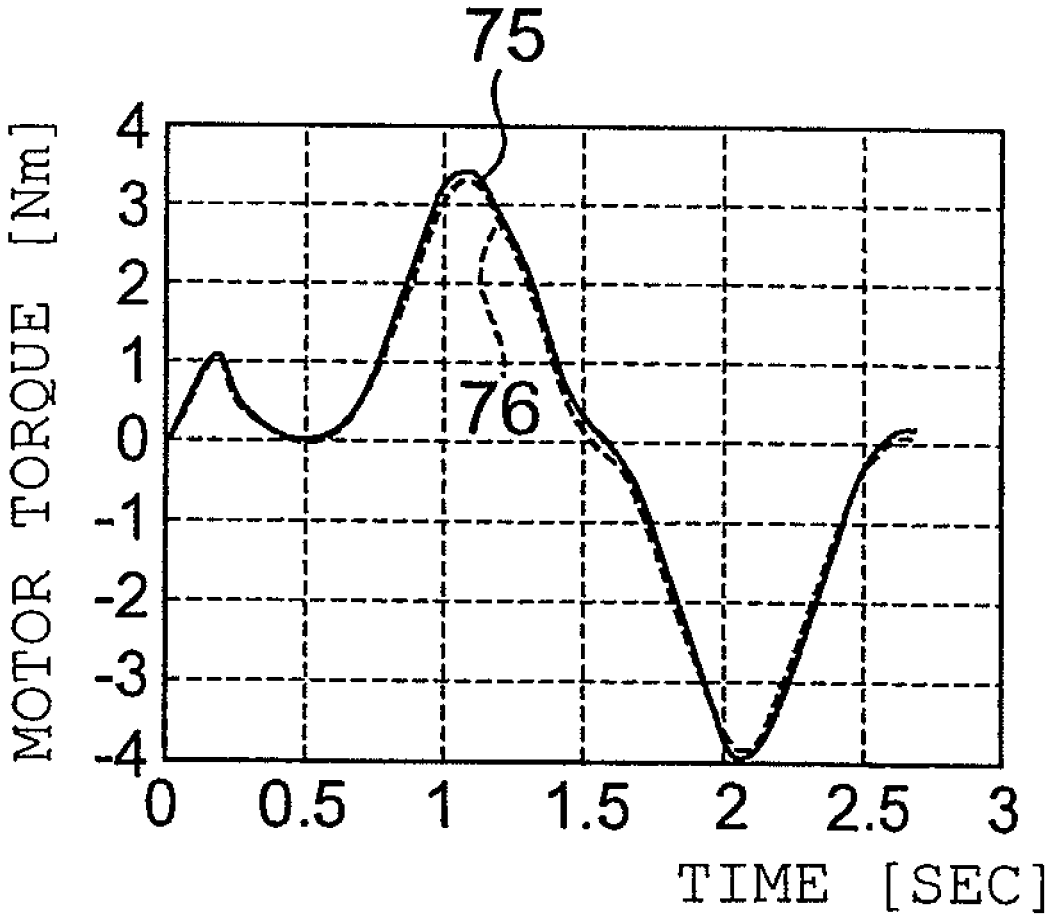
FIG. 11 is a graph showing temporal change of the respective output torques of the first and second door drive devices which are controlled by the arithmetic processing of the first and second CPUs shown in FIG. 10.

FIG. 11 is a graph showing temporal change of the respective output torques of the first and second door drive devices 9 and 10 which are controlled by the arithmetic processing of the first and second CPUs 31 and 36 shown in FIG. 10. As shown in the figure, a difference between the output torque 75 of the first door drive device 9 and the output torque 76 of the second door drive device 10 is smaller than that when the door speed command information from the speed pattern calculation section 41 is the intermediate processing information (FIG. 5).

Accordingly, when the difference between the door speed command information from the speed pattern calculation section 41 and the first rotating angle speed information from the first differential section 42 is the intermediate processing information, temporal displacement occurs between the first and second torque command information that are calculated by the first speed control sections 46 and 53, respectively. However, it is understood that the temporal displacement is extremely small as the difference between the respective output torques of the first and second door drive devices 9 and 10. That is, it is found that the unbalance of the respective output torques of the first and second door drive devices 9 and 10, which is caused by the receive delay of the intermediate processing information of the second individual processing section 40 with respect to the first individual processing section 39 is suppressed even if no correction is performed under control.

In the above door device for an elevator, the difference between the door speed command information from the speed pattern calculation section 41 and the first rotating angle speed information from the first differential section 42 is transmitted to the second individual processing section 40 as the intermediate processing information. As a result, the difference between the respective output torques of the first and second door drive devices 9 and 10 can be further reduced without performing the controlled correction. With the above configuration, the overload of the first and second door drive devices 9 and 10 and the like can be further prevented from occurring.

Fourth Embodiment

Figure 12:
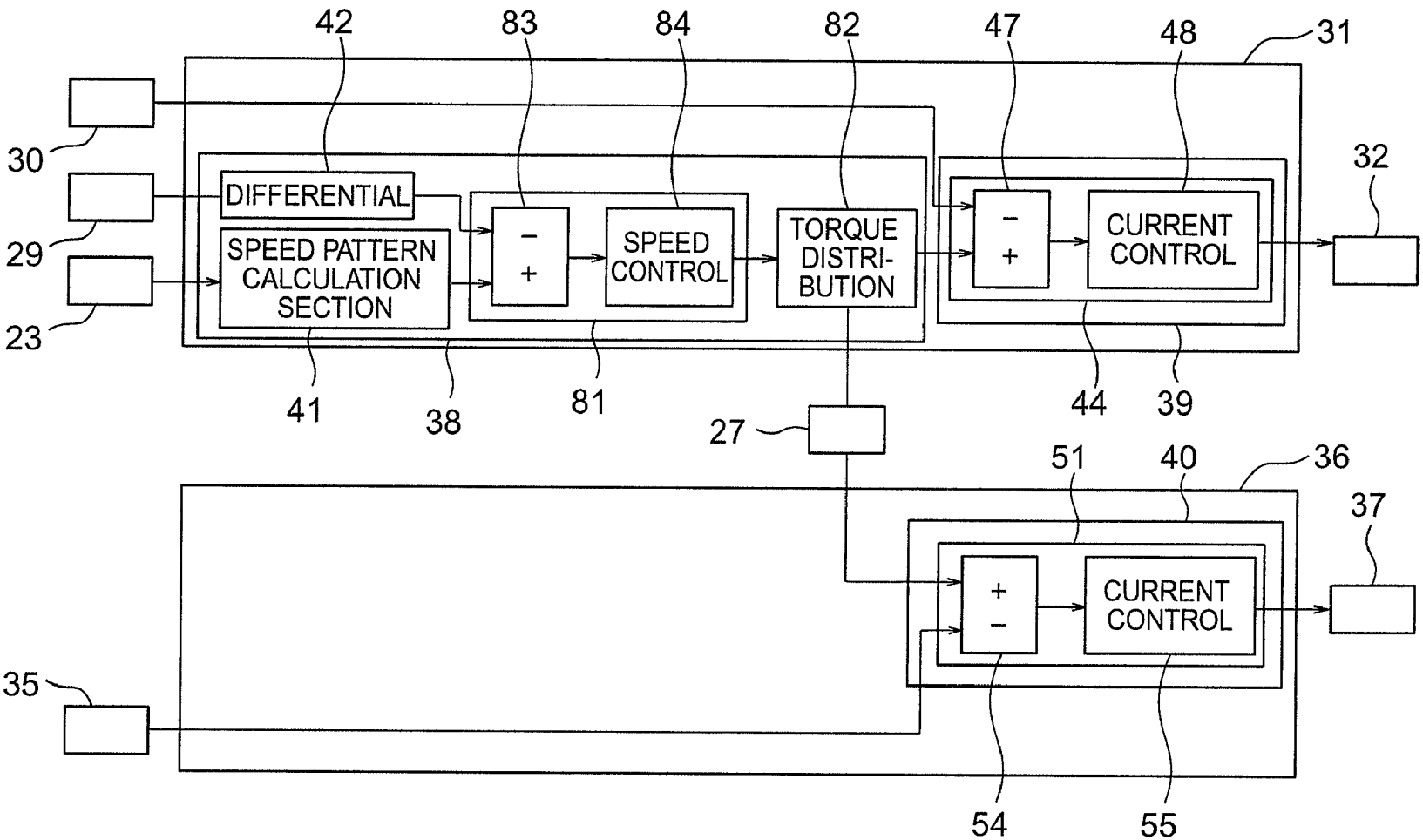
FIG. 12 is a block diagram showing the main portion of a door device for an elevator according to a fourth embodiment of the present invention.

FIG. 12 is a block diagram showing the main portion of a door device for an elevator according to a fourth embodiment of the present invention. In the figure, the single processing section 38 includes the speed pattern calculation section 41, the first differential section 42, a total torque command section 81, and a torque distribution section 82. The configurations and functions of the speed pattern calculation section 41 and the first differential section 42 are identical with those in the first embodiment.

The total torque command section 81 calculates the total of the respective torque commands of the first and second door drive devices 9 and 10 as total torque command information based on the door speed command information from the speed pattern calculation section 41 and the first rotating angle speed information from the first differential section 42. Also, the total torque command section 81 includes a speed information comparison section 83 that obtains a difference between the door speed command information and the first rotating angle speed information, and a speed control section 84 that calculates the total torque command information based on the information from the first speed information comparison section 45.

The total torque command information from the total torque command section 81 is transmitted to the torque distribution section 82. The torque distribution section 82 divides the total torque command information into first torque command information and second torque command information. The distribution factor of the first torque command information and the second torque command information is set in the torque distribution section 82 in advance. In this example, in the torque distribution section 82, there are set a plurality of distribution factors including a first side emphasis distribution factor for making the first torque command information larger than the second torque command information, an equal distribution factor for making the first and second torque command information equal to each other in magnitude, and a second side emphasis distribution factor for making the second torque command information larger than the first torque command information. The torque distribution section 82 adjusts the distribution factors of the first and second torque command information based on the information on the respective output torques of the first and second door drive devices 9 and 10. The adjustment of the distribution factors in the torque distribution section 82 is performed by selecting any distribution factor from the respective distribution factors that have been set in advance.

The first torque command information is transmitted to the first voltage command section 44 from the torque distribution section 82 as the intermediate processing information. The second torque command information is transmitted to the second voltage command section 51 from the torque distribution section 82 through the signal line 27 as the intermediate processing information. Accordingly, the first voltage command section 44 is constituted by the first individual processing section 39, and the second voltage command section 51 is constituted by the second individual processing section 40. The configurations and functions of the first and second voltage command sections 44 and 51 are identical with those in the first embodiment.

Figure 13:
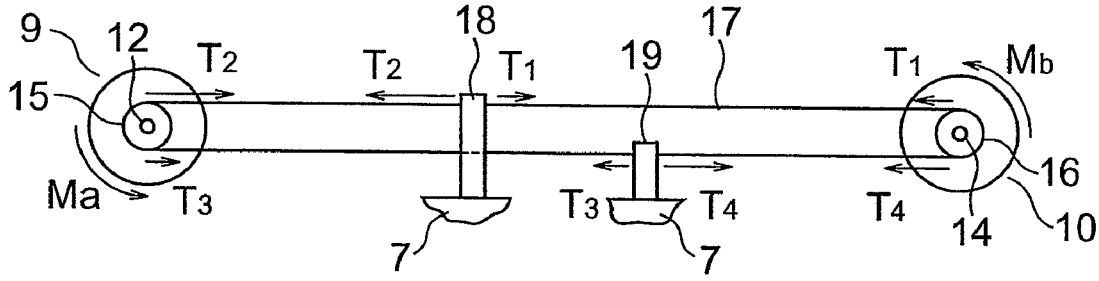
FIG. 13 is a configuration diagram showing a power transmission mechanism in the door device for the elevator shown in FIG. 11.

Now, the tension of the toothed belt 17 will be described. FIG. 13 is a configuration diagram showing a power transmission mechanism in the door device for the elevator shown in FIG. 11. In the figure, a tension T1 is given to a portion between the second pulley 16 of the toothed belt 17 and one coupling member 18, and a tension T2 is given to a portion between the first pulley 15 of the toothed belt 17 and one coupling member 18. Also, a tension T3 is given to a portion between the first pulley 15 of the toothed belt 17 and another coupling member 19, and a tension T4 is given to a portion between the second pulley 16 of the toothed belt 17 and another coupling member 19.

When an output torque Ma of the first door drive device 9 is generated, the tension T2 becomes larger, and the tension T3 becomes smaller. Also, when an output torque Mb of the second door drive device 10 is generated, the tension T4 becomes larger, and the tension T1 becomes smaller. As a result, a difference occurs between the tension T2 and the tension T1, and a difference occurs between the tension T3 and the tension T4, respectively, to thereby move the toothed belt 17. For example, an engagement device for engaging the doors 4 of the car with the doors of an elevator hall is located on only one of the respective doors 4 of the car. As a result, the weight of the door 4 of the car which is equipped with one coupling member 18 is different from the weight of the door 4 of the car which is equipped with another coupling member 19.

Figure 14:
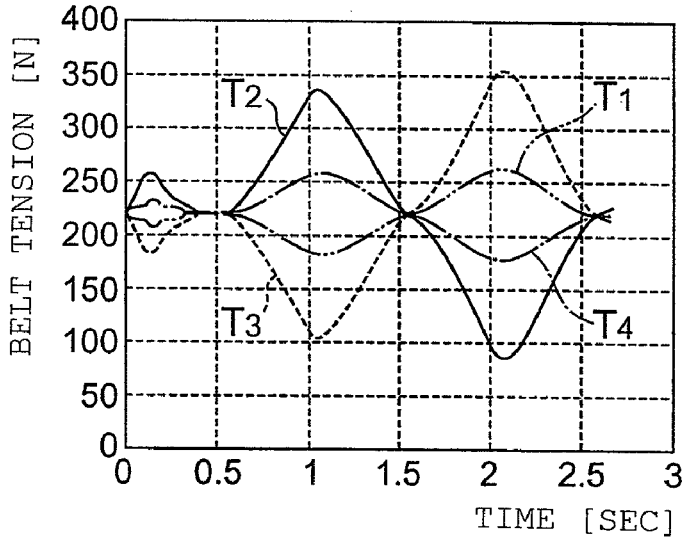
FIG. 14 is a graph showing a temporal change of the tensions of the toothed belt in the door open operation when the distribution factor in the torque distribution section shown in FIG. 12 is set to the equal distribution factor.

FIG. 14 is a graph showing a temporal change of the tensions T1 to T4 of the toothed belt 17 in the door open operation when the distribution factor in the torque distribution section 82 shown in FIG. 12 is set to the equal distribution factor (1:1). As shown in the figure, the tension T1 is changed in a direction opposite to the tension T2, and the tension T3 is changed in a direction opposite to the tension T4. In this case, the maximum values of the tension T2 and the tension T3 are larger than the maximum values of the tension T1 and the tension T4, and the minimum values of the tension T2 and the tension T3 are smaller than the minimum values of the tension T1 and the tension T4.

In the case where the distribution factor in the torque distribution section 82 is constant, when at least any one of the tensions T1 to T4 is extremely large, vibrations or sounds occur, and when at least any one of the tensions T1 to T4 is extremely small, looseness occurs.

Figure 15:
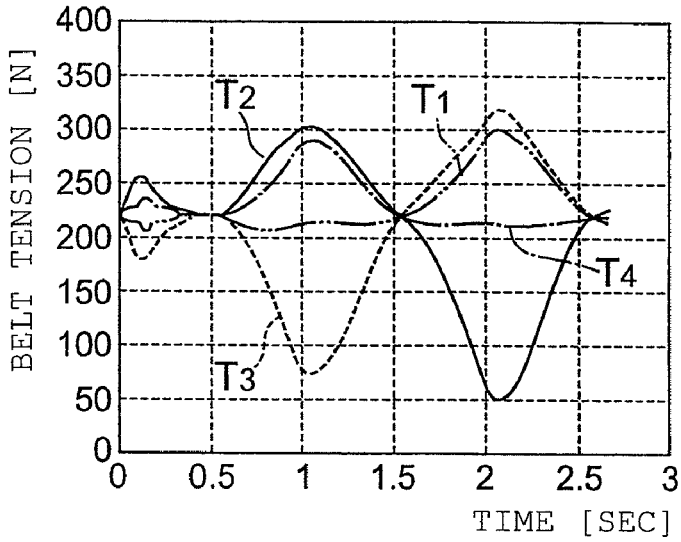
FIG. 15 is a graph showing a temporal change of the tensions of the toothed belt in the door open operation in the case where a control is performed on the torque distribution section of FIG. 12 so that the first side emphasis distribution factor is set when the total of the respective output torques of the first and second door drive devices is positive, and the second side emphasis distribution factor is set when the total of the respective output torques is negative.

FIG. 15 is a graph showing a temporal change of the tensions T1 to T4 of the toothed belt 17 in the door open operation in the case where a control is performed on the torque distribution section 82 of FIG. 12 so that the first side emphasis distribution factor is set when the total (Ma+Mb) of the respective output torques of the first and second door drive devices 9 and 10 is positive (when the respective doors 4 of the car are accelerated), and the second side emphasis distribution factor is set when the total (Ma+Mb) of the respective output torques is negative (when the respective doors 4 of the car are decelerated).

As shown in the figure, in this case, the maximum values of the tension T2 and the tension T3 are lower than those win the case where the distribution factor of the first and second torque command information is made identical (FIG. 14). As a result, all the maximum values of the tensions T1 to T4 are suppressed to lower values to prevent the occurrence of the vibrations and sounds.

From the above viewpoint, in order to prevent the occurrence of the vibrations and sounds, the torque distribution section 82 makes the first torque command information larger than the second torque command information when the total (Ma+Mb) of the respective output torques of the first and second door drive devices 9 and 10 is positive, and makes the first torque command information smaller than the second torque command information when the total of the respective output torques is negative.

Figure 16:
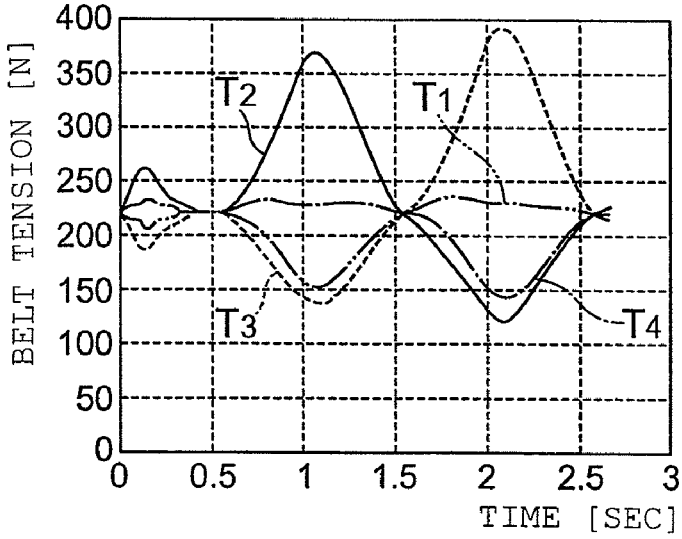
FIG. 16 is a graph showing a temporal change of the tensions of the toothed belt in the door open operation in the case where a control is performed on the torque distribution section of FIG. 12 so that the second side emphasis distribution factor is set when the total of the respective output torques of the first and second door drive devices is positive, and the first side emphasis distribution factor is set when the total of the respective output torques is negative.

FIG. 16 is a graph showing a temporal change of the tensions T1 to T4 of the toothed belt 17 in the door open operation in the case where a control is performed on the torque distribution section 82 of FIG. 12 so that the second side emphasis distribution factor is set when the total (Ma+Mb) of the respective output torques of the first and second door drive devices 9 and 10 is positive, and the first side emphasis distribution factor is set when the total (Ma+Mb) of the respective output torques is negative. As shown in the figure, in this case, the minimum values of the tension T2 and the tension T3 are higher than those in the case where the distribution factor of the first and second torque command information is made identical (FIG. 14). As a result, all the minimum values of the tensions T1 to T4 are held higher to prevent the occurrence of the looseness.

From the above viewpoint, in order to prevent the occurrence of the looseness, the torque distribution section 82 makes the first torque command information smaller than the second torque command information when the total (Ma+Mb) of the respective output torques of the first and second door drive devices 9 and 10 is positive, and makes the first torque command information larger than the second torque command information when the total of the respective output torques is negative. Other configurations and functions are identical with those in the first embodiment.

In the above door device for an elevator, the total torque command information is distributed to the first and second torque command information by means of the torque distribution section 82, and the respective first and second torque command information is transmitted to the first individual processing section 39 and the second individual processing section 40 as the intermediate processing information. As a result, it is unnecessary to calculate the output torque by each of the first and second CPUs 31 and 36, individually, and the calculation load of the second CPU 36 can be reduced.

Also, since the distribution factors of the first and second torque command information distributed by the torque distribution section 82 can be adjusted, the respective output torques of the first and second door drive devices 9 and 10 can be adjusted, individually, and the vibrations, sounds, and looseness of the toothed belt 17 can be prevented from occurring.

Fifth Embodiment

Figure 17:
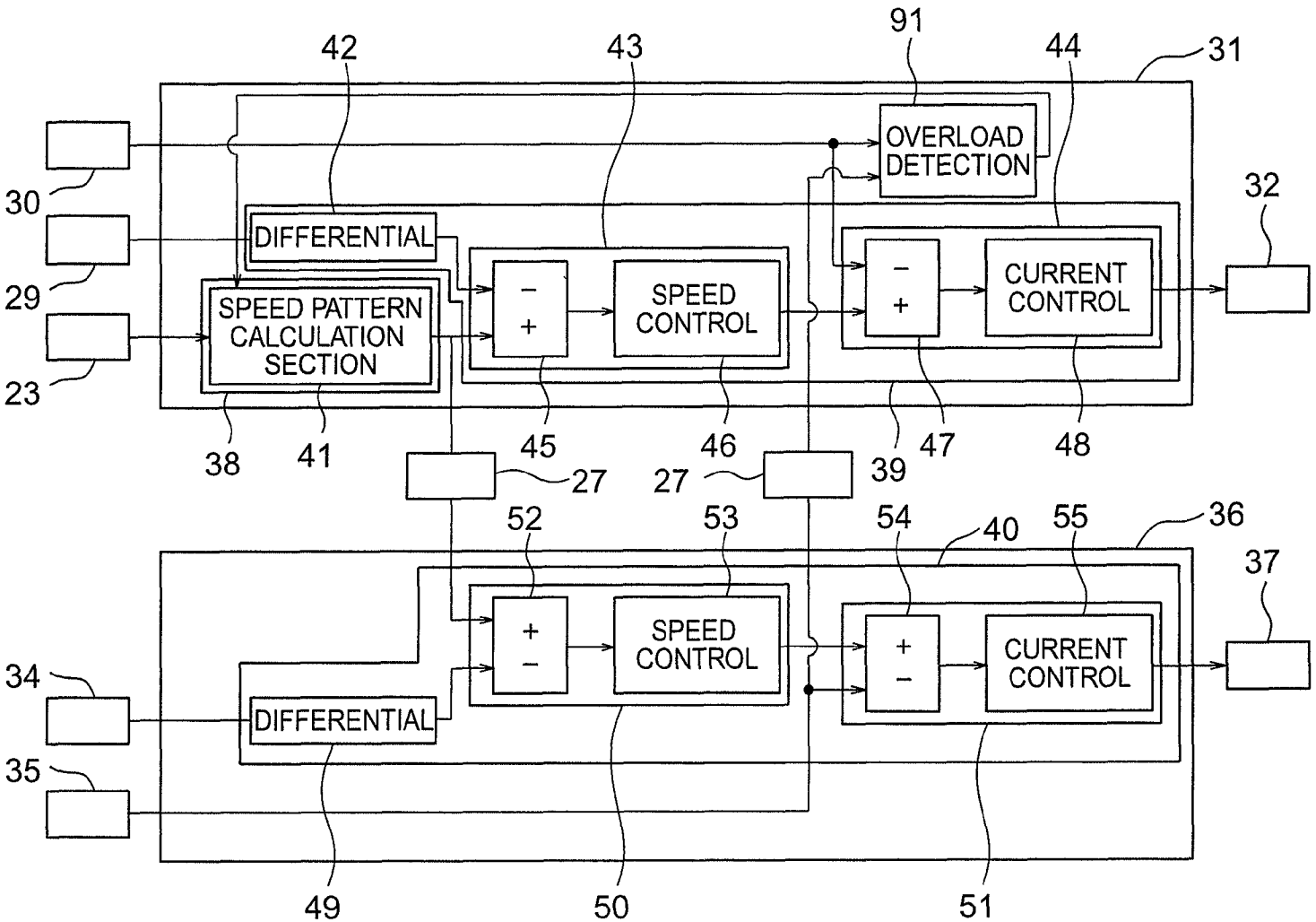
FIG. 17 is a block diagram showing the main portion of a door device for an elevator according to a fifth embodiment of the present invention.

FIG. 17 is a block diagram showing the main portion of a door device for an elevator according to a fifth embodiment of the present invention. In the figure, the first CPU 31 is equipped with an overload detection section 91 that compares the first output torque information from the first current detector digital converter 30 with the second output torque information from the second current detector digital converter 35 to detect the presence or absence of the overload. That is, the overload detection section 91 compares the respective information of the first current detector 28 and the second current detector 33 with each other to detect the presence or absence of the overload.

A given threshold value is set in the overload detection section 91 in advance. The overload detection section 91 performs normality determination that no overload occurs when a difference between the first and second output torque information is smaller than the given threshold value, and performs abnormality determination that the overload occurs when the difference between the first and second output torque information is equal to or larger than the given threshold value.

The overload detection section 91 transmits an reverse command for reversing the movement of the respective doors 4 of the car to the speed pattern calculation section 41 when the abnormality determination is performed. Upon receiving the reverse command, the speed pattern calculation section 41 calculates a predetermined reverse speed pattern, and outputs the reverse speed pattern as the door speed command information. Other configurations are identical with those in the first embodiment.

In the above door device for an elevator, the overload detection section 91 that compares the first and second output torque information corresponding to the respective output torques of the first and second door drive devices 9 and 10 with each other to detect the presence or absence of the overload is disposed in the first CPU 31. Therefore, it is possible to readily detect the presence or absence of any overload of the first and second door drive devices 9 and 10. As a result, the occurrence of failure can be detected early, and the expansion of the failure can be prevented.

In the above example, the overload detection section 91 is disposed in the first CPU 31. Alternatively, the overload detection section 91 can be disposed in the second CPU 36.

Sixth Embodiment

Figure 18:
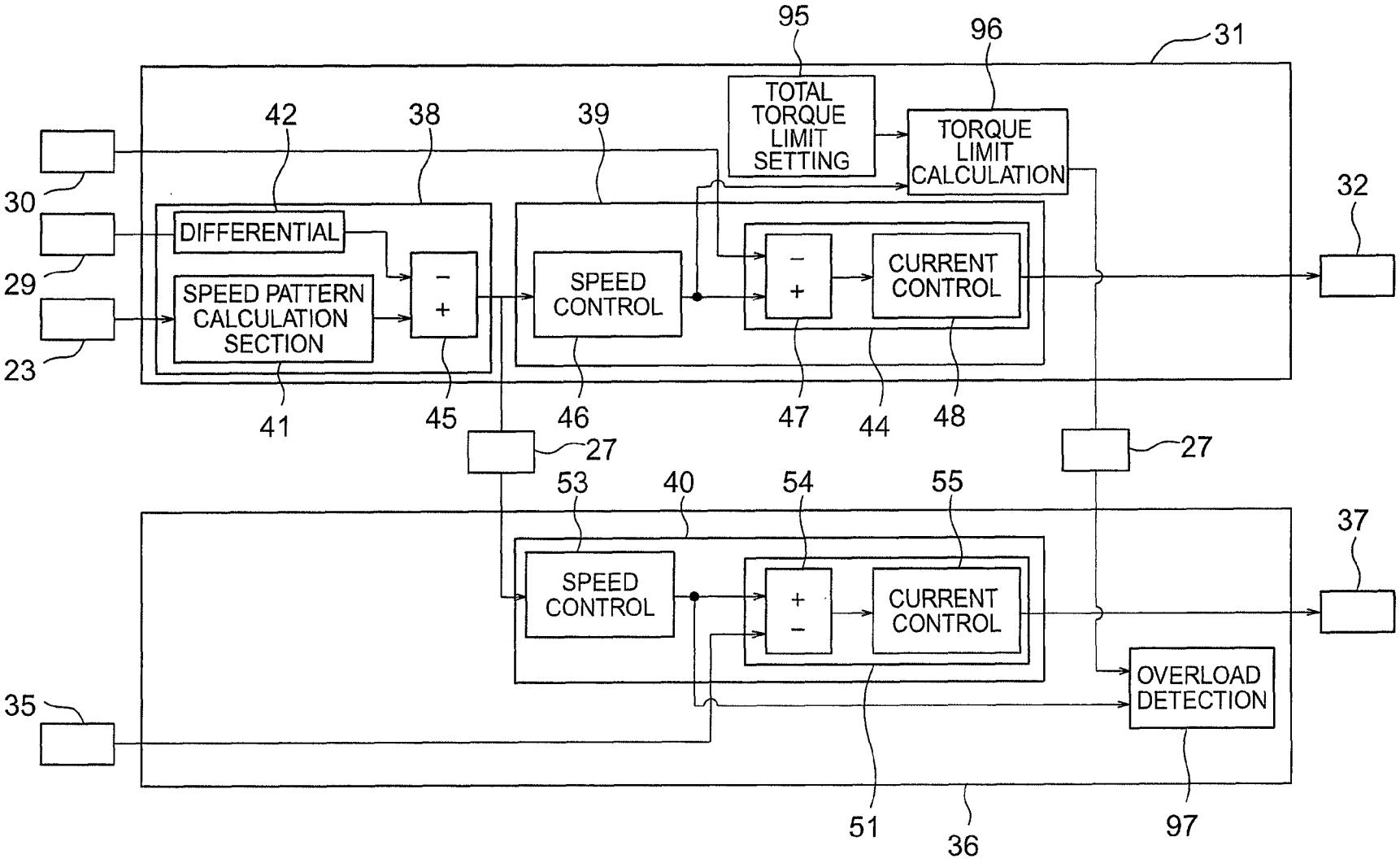
FIG. 18 is a block diagram showing the main portion of a door device for an elevator according to a sixth embodiment of the present invention.

FIG. 18 is a block diagram showing the main portion of a door device for an elevator according to a sixth embodiment of the present invention. In the figure, the first CPU 31 is equipped with a total torque limit setting section 95 and a torque limit information calculation section 96.

The total of a limit value of the torque command for controlling the output torque of the first door drive device 9, and a limit value of the torque command for controlling the output torque of the second door drive device 10 is set in the total torque limit setting section 95 as total torque limit information in advance. The total torque limit information is determined, for example, according to the weights of the respective doors 4 of the car.

The torque limit information calculation section 96 calculates a difference between the first torque command information from the first speed control section 46 and the total torque limit information from the total torque limit setting section 95 as distribution torque limit information. The distribution torque limit information is transmitted to the second CPU 36 from the torque limit information calculation section 96 through the signal line 27.

The second CPU 36 is equipped with an overload detection section 97 that compares the distribution torque limit information from the torque limit information calculation section 96 and the second torque command information from the second speed control section 53 to detect the presence or absence of the overload.

A given threshold value is set in the overload detection section 97 in advance. The overload detection section 97 performs the normality determination that there occurs no overload when a difference between the distribution torque limit information and the second torque command information is smaller than a given threshold value, and performs the abnormality determination that there occurs the overload when the difference between the distribution torque limit information and the second torque command information is equal to or larger than a given threshold value.

When the overload detection section 97 performs the abnormality determination, a reverse command is transmitted from the overload detection section 97 to the speed pattern calculation section 41 to reverse the movement of the respective doors 4 of the car. Other configurations are identical with those in the third embodiment.

In the above door device for an elevator, the difference between the first torque command information and the total torque limit information which is set in advance is calculated as the distribution torque limit information, and the distribution torque limit information and the second torque command information are compared with each other to detect the presence or absence of the overload. Therefore, even if the difference between the first and second torque command information is small, the total of the first and second torque command information becomes equal to or higher than the total torque limit information, thereby making it possible to detect the occurrence of the overload. Accordingly, the presence or absence of the overload can be further surely detected.

The invention claimed is:

1. A door device for an elevator, comprising:

an elevator door that opens and closes an elevator doorway;

a first door drive device having a first rotating shaft;

a second door drive device having a second rotating shaft;

a power transmission mechanism that couples the first rotating shaft to the second rotating shaft and moves the elevator door in response to rotation of the first and second shafts; and a door control device that controls movement of the elevator door and includes:

a first processing device that performs first arithmetic processing for controlling the first door drive device;

a second processing device that performs second arithmetic processing for controlling the second door drive device; and information transmitting means for transmitting information mutually between the first and second processing devices, wherein the first processing device includes a single processing section that performs part of the first arithmetic processing and calculates intermediate processing information, and a first individual processing section that processes the intermediate processing information to complete the first arithmetic processing, and the second processing device includes a second individual processing section that processes the intermediate processing information that is received through the information transmitting means to complete the second arithmetic processing.

2. The door device for an elevator according to claim 1, wherein the single processing section includes a speed pattern calculation section that calculates a speed pattern for controlling respective rotating speeds of the first and second rotating shafts as door speed command information, and the intermediate processing information is the door speed command information.

3. The door elevator for an elevator according to claim 2, wherein the first individual processing section includes a first torque command section that calculates, based on the door speed command information, a torque command for controlling output torque of the first door drive device as first torque command information, the second individual processing section includes a second torque command section that calculates, based on the door speed command information, a torque command for controlling output torque of the second door drive device as second torque command information, and a follow-up property of the second torque command section with respect to the door speed command information is higher than a follow-up property of the first torque command section with respect to the door speed command information.

4. The door device for an elevator according to claim 2, wherein the second individual processing section includes a phase lead section that performs phase lead compensation on the door speed command information.

5. The door device for an elevator according to claim 2, wherein the first individual processing section includes a first torque command section that calculates, based on the door speed command information, a torque command for controlling output torque of the first door drive device as first torque command information, the second individual processing section includes a second torque command section that calculates, based on the door speed command information, a torque command for controlling output torque of the second door drive device as second torque command information, and one of the first and second processing devices includes a torque limit information calculation section that calculates difference between the first torque command information and total torque limit information which has been set in advance, as distribution torque limit information, and an overload detection section that compares the distribution torque limit information to the second torque command information to detect an overload.

6. The door device for an elevator according to claim 1, further comprising a first speed detector that generates a signal corresponding to the rotation of the first rotating shaft, wherein the single processing section includes a speed pattern calculation section that calculates a speed pattern for controlling respective rotating speeds of the first and second rotating shafts as door speed command information, and a speed information comparison section that calculates difference between the door speed command information and information from the first speed detector as the intermediate processing information.

7. The door device for an elevator according to claim 1, wherein the single processing section includes:

a speed pattern calculation section that calculates a speed pattern for controlling respective rotating speeds of the first and second rotating shafts as door speed command information;

a total torque command section that calculates, based on the door speed command information, total of respective torque commands of the first and second door drive devices as total torque command information; and a torque distribution section that divides the total torque command information into first and second torque command information, outputs the first torque command information to the first individual processing section as the intermediate processing information, and outputs the second torque command information to the second individual processing section as the intermediate processing information.

8. The door device for an elevator according to claim 7, wherein a distribution factor of the first torque command information and the second torque command information by the torque distribution section is adjustable.

9. The door device for an elevator according to claim 1, further comprising:

a first torque detector that detects output torque of the first door drive device; and a second torque detector that detects output torque of the second door drive device, wherein one of the first and second processing devices includes an overload detection section that compares information from the first torque detector and information from the second torque detector to detect an overload.

10. The door device for an elevator according to claim 1, wherein, when an abnormality occurs in one of the first and second processing devices, abnormality detection information is transmitted from one of the first and second drive processing devices to the other of the first and second drive processing devices through the information transmitting means.

* * * * *